United States Patent [19]

Kozono et al.

[11] 4,344,310

[45] Aug. 17, 1982

[54] METHOD OF ROLLING RAILROAD-RAILS AND STEELS OF SIMILAR SHAPE BY UNIVERSAL ROLLING

[75] Inventors: Haruo Kozono; Hiroshi Higashinaka, both of Kitakyushu, Japan

[73] Assignee: Nippon Steel Corporation, Tokyo, Japan

[21] Appl. No.: 172,443

[22] Filed: Jul. 25, 1980

[30] Foreign Application Priority Data

Aug. 3, 1979 [JP] Japan ..... 54/98663

[51] Int. Cl.[3] ..... B21B 13/10

[52] U.S. Cl. ..... 72/225; 72/8; 72/234

[58] Field of Search ..... 72/234, 21, 225, 8, 72/9, 6

[56] References Cited

U.S. PATENT DOCUMENTS

| | | | |
|---|---|---|---|
| 3,342,053 | 9/1967 | Stammbach | 72/225 |
| 3,583,193 | 6/1971 | Kishikawa | 72/225 |
| 3,901,059 | 8/1975 | Nakajima | 72/8 |

FOREIGN PATENT DOCUMENTS

| | | | |
|---|---|---|---|
| 428533 | 5/1926 | Fed. Rep. of Germany . | |
| 1960601 | of 1970 | Fed. Rep. of Germany . | |
| 1252496 | of 1971 | Japan . | |
| 52-16061 | 5/1977 | Japan | 72/6 |

OTHER PUBLICATIONS

"On Reconstruction of Rail Mill & Newly-Developed Rails of Nippon Steel Corporation," Nippon Steel Technical Report, Jun. 1973, pp. 1-21.

*Primary Examiner*—Leon Gilden

*Attorney, Agent, or Firm*—Cushman, Darby & Cushman

[57] ABSTRACT

A method for multiple pass rolling of railroad-rails in a universal rolling mill having horizontal rolls and vertical rolls, comprising measuring the axial displacement of the horizontal rolls and the radial displacement of the vertical rolls when a blank passes through a roll caliber defined by the horizontal and vertical rolls. The measurements include the relation of the displacement of the horizontal and vertical rolls and the difference of the rolling forces acting on the rolls each of the two vertical rolls. The values of the rolling forces of the vertical rolls during the intented passes, can be calculated, by arithmetic operations, independently of the above mentioned measuring so as to estimate the axial displacements of the horizontal rolls and radial displacements of the vertical rolls before the rolling by consequent pass is actually performed. On the basis of the calculated values and of the above mentioned relation, the roll gap settings between the horizontal rolls and the vertical rolls can be made that permits the controlled consecutive passes by a universal rolling mill.

2 Claims, 17 Drawing Figures

PASS Nos. 9~11

PASS Nos. 9′, 11′

PASS No. 12

PASS Nos. 9~13

PASS Nos. 9′, 11′

METHOD OF ROLLING RAILROAD-RAILS AND STEELS OF SIMILAR SHAPE BY UNIVERSAL ROLLING

This invention relates to a multiple pass rolling method for producing railroad-rails and steels of similar shape (having unequal thicknesses at the heads and bases thereof) by means of the same four roll universal stand having a single contour.

The method of rolling a blank to form railroad-rails or steels of similar shape by four roll universal rolling is superior to the two-high method, in dimensional accuracy and shape of the finished products. One example of the four roll universal rolling method has been disclosed in detail in U.S. Pat. No. 3,342,053. According to the disclosure in this publication, a blank can be repetitively rolled as many as five times through the upper surface rolling pass stand and side surface rolling pass stand, thereby enabling one set of rolling mills to perform the rolling operation equivalent to that of universal mills for wide flange beams. At present, however, only two kinds of universal rolling systems for rails are used in the world. In neither system is the method of multiple pass rolling through the same stand actually used without augmentation. Both of the present rolling methods require an additional rolling stand with a sizing pass or the compound processes of a so-called "double universal" system. FIGS. 1*a* and 1*b* illustrate one example of the two systems, wherein the rail rolling installation illustrated in FIG. 1*a* comprises a break-down mill 21, a roughing mill 22 having horizontal rolls, a universal rolling mill 23 having horizontal and vertical rolls for the multiple pass rolling, an edger mill 24, a universal rolling mill 25 for a sizing pass, an edger mill 26 and a finishing mill 27. The numerals preceded by "No" in the drawings denote the pass numbers. FIG. 1*b* illustrates the pass schedule with numbers corresponding to the pass numbers in FIG. 1*a*. With this rolling installation, the same four roll universal rolling mill 23 and edger mill 24 roll the blank three times. However, this installation requires a universal rolling mill 25, subsequent to the universal rolling mill 23, for performing the sizing roll of the blank. Furthermore, in the universal rolling mill 23, the roll gaps between the horizontal rolls and the vertical rolls vary due to the rolling force acting on the rolls, but no effective method for compensating the variation of the roll gaps is provided. The discussion will be now directed to why repeated rolling in the same four roll universal stand without augmentation is difficult. The four roll universal rolling method has been developed, because it is possible to effectively produce wide flange beams which are horizontally and vertically symmetrical. The wide flange beams are produced from blooms with a square cross section, by rolling them repetitively through varying clearances between rolls of a small number of mills. However, if blooms having symmetrical cross-sections are rolled to form rails or the like which have heads and bases asymmetrical to each other, horizontal rolls will be subjected to large axial forces. With the four-roll universal rolling method, the rolls have a greater flexibility with regard to relative positioning to each other than in the two-high mill. The known mechanical "screw down" method of positioning the rolls relative to each other in conventional processes is difficult to alter for repetitive roll passes. Of course, the hydraulic process for roll positioning is also available, but for economic reasons is not feasible.

As can be understood from the above discussion, when rails are produced from square blooms by universal rolling, at least five rolling mill and edger mill groups are required, as in the prior art systems. Therefore, the systems require a great amount of investment in comparison with the wide flange beam mill which has a multiple pass capability and requires only three universal rolling mills. Because of the difficulties in positioning the rolls relative to each other for repetitive rolling of rails, a greater number of universal roll stands are required than in the wide flange beam rolling method.

The mechanical "screw down" method for positioning the rolls relative to each other requires a theoretical explanation. The mechanical rigidities of a conventional rolling mill having a screw down system will now be discussed. The web of a rail is rolled by a pair of horizontal rolls and the head and the base of the rail are rolled by a pair of vertical rolls. A horizontal roll axial displacement measuring mechanism is mounted at one end of a shaft of each horizontal roll.

The relationships between a rolling force P in a radial direction of the roll, a mill modulus (a modulus of the rigidity of a mill) M, a roll gap S between the vertical rolls and the horizontal rolls, and an outgoing thickness $h_2$ of a rolled material (blank) is generally represented by the following equation.

$$h_2 = S + P/M \tag{1}$$

This equation is illustrated in a graph showing rolling force vs. material thickness curves (mill rigidity vs. material plasticity curves) in FIG. 2. A curve f ($h_1$, $h_2$) is a rolling force curve based on an ingoing thickness $h_1$ of the material.

It has been also found by the analysis of axial displacements of the horizontal rolls, by the use of roll position sensors and vertical roll force meters (load cells), that the axial displacements vs. roll forces curve usually includes an insensible zone or a dead band d (see FIG. 5) where there could be free displacement $\Delta S$ without the force difference $\Delta P$ between the head and the base vertical rolls. Large axial displacements could be caused by a small amount of the force differences. If a large axial displacement of the horizontal rolls is caused by a small variation of "$\Delta P$," then it can be concluded that the rigidity of the mill is not great. The abscissa in FIG. 5 indicates the axial displacements $\Delta S$ of the horizontal rolls.

With the prior art mill, therefore, if it is desired to roll materials to form asymmetrical shaped steels (rails or the like) using the four roll universal rolling method, the rolls would be greatly displaced during rolling from their pre-rolling positions. Conventional "screw down" mills cannot perform this kind of dynamic control function. Therefore, multiple rolls cannot be carried out without any auxiliary mill such as 25 in FIG. 1*a*. As far as the radial displacements are concerned, it might be possible with the "screw down system" to control dynamically the roll gaps of the horizontal and vertical rolls. However, dynamic control of the axial displacement is not possible in the mechanical "screw down system."

A serious disadvantage in the conventional method illustrated in FIGS. 1*a* and 1*b* is that it requires five major rolling mills.

It is the object of the present invention to provide an improved method for producing rolled rail sections or steels of similar shape using the four roll universal rolling method which eliminates the above mentioned disadvantages.

The present invention makes it possible to reduce the number of major rolling mills. It is possible to use three or four major rolling mills in place of five. This would, of course, reduce the initial capital investment as well as the attendant operating costs. It also makes it possible for rails to be rolled with a high degree of accuracy. Also, no major modifications of the universal rolling mill are necessary. A small number of inexpensive rolling mills with conventional "screw down" vertical roll and horizontal roll controls as used in convention technology, are used. An overview of this invention begins with an analysis of the characteristics of the rolling mill. The first characteristic, that is, "roll gap" prior to rolling, is determined by the read-out from the screw down mechanism. Roll force is measured as the second by a load cell or the like. The third characteristic to be analyzed is the axial displacement during the roll which is measured by the axial displacement sensor (roll position sensor). Arrangements of calibers and pass schedules are determined in consideration of the above mentioned characteristics in a manner explained later. As a result, the undesirable effects of the axial displacements of the horizontal rolls during rolling can be eliminated and, therefore, single caliber rolling mills have a multipass capability equivalent to the wide flange beam rolling. As a consequence of this capability, the final pass (or equivalent to the final pass of the multipass phase) "metal touch" rolling (detailed description to follow) can be performed. This final pass (or equivalent) in the multipass phase has the function of sizing the head of the rail blank with collateral reduction in the sectional area of the rail blank. Ordinarily, this sizing pass is performed by an additional rolling mill.

The ideal rolling technology would incorporate the advantages of the metal extrusion process (precise contour) with high productivity of the rolling process. When the vertical rolls are pressed against the sides of the horizontal rolls a rolling space is formed that theoretically would produce a rolled contour as precise as extrusion dies. However, because there is a vertical roll separation caused by the roll force, the vertical roll on the head side of the rail blank (hereinafter called the "head roll") must be pressed against the sides of the horizontal rolls to counteract this force. The head roll before the sizing pass in the multipass phase is placed in a precalculated position against the sides of the horizontal rolls to take advantage of the axial displacement of the horizontal rolls, thereby creating a "metal touch" condition between the horizontal rolls and the head roll. Such a metal touch rolling method can effect rolling with a high degree of accuracy, which is equivalent to that of extruding, and with a high productivity of rolling. It should be noted that metal touch rolling is different in function from a conventional vertical roll contact rolling (e.g. see U.S. Pat. No. 3,583,193).

The present invention will hereinafter be explained in detail with reference to examples of its application to rail rolling, and with reference to the drawings in which:

FIGS. 1*a* and 1*b* are illustrations showing one example of a rolling installation and a pass schedule for a conventional known railroad-rail universal rolling system, respectively;

FIG. 2 is a roll force-thickness diagram for a conventional mill for rolling of a sheet metal;

FIG. 3*a* illustrates an arrangement of a rolling installation for carrying out the rolling method according to the invention;

FIG. 3*b* illustrates a pass schedule for the rolling method according to the invention;

FIGS. 3*c* and 3*d* are views illustrating partly enlarged pass schedules of FIGS. 1*b* and 3*b*, in rolling methods using universal rail rolling installations are illustrated in FIG. 1*a* and FIG. 3*a* according to the prior art and present invention, respectively;

Figure 8:
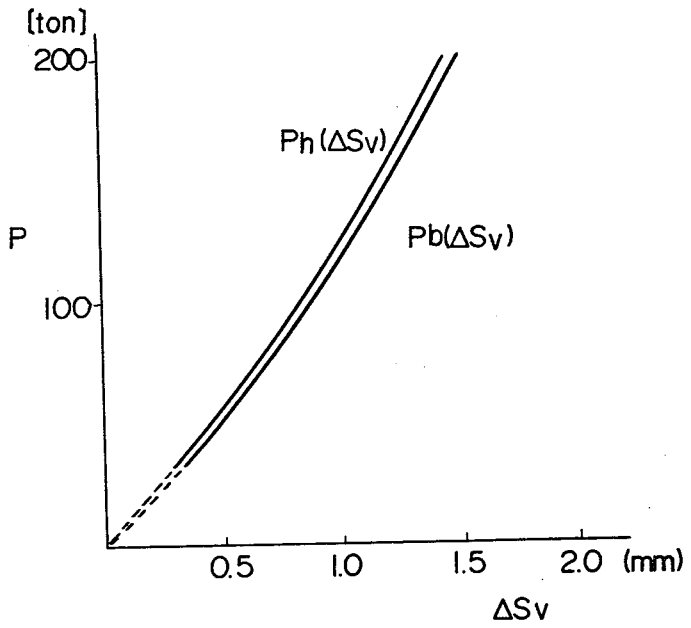
FIG. 8 is a vertical roll separation (radial displacement)-vertical roll force diagram showing one example of the relationships btween mill spring and rolling force acting upon the vertical rolls.
Figure 9A:
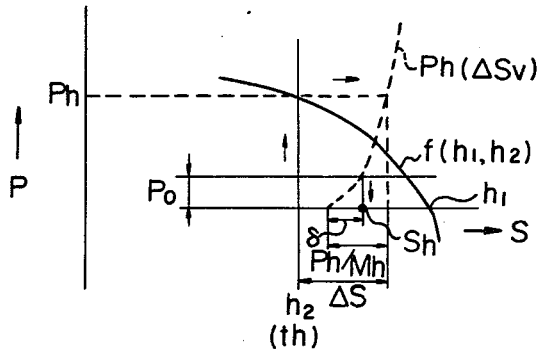
Figure 9B:
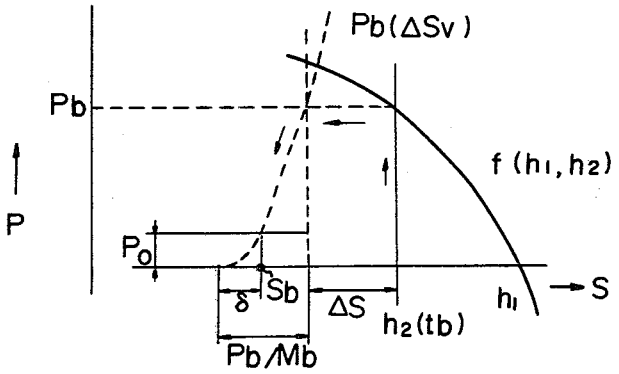
Figure 10:
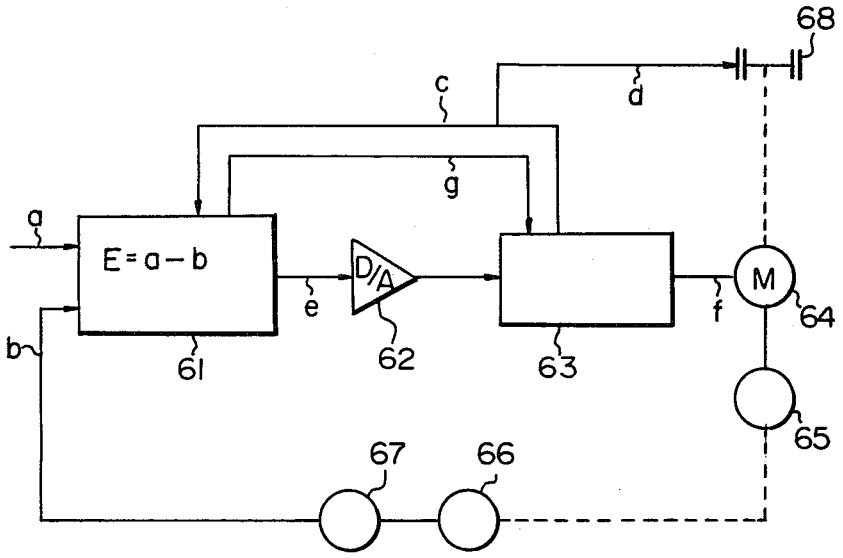
Figure 11:
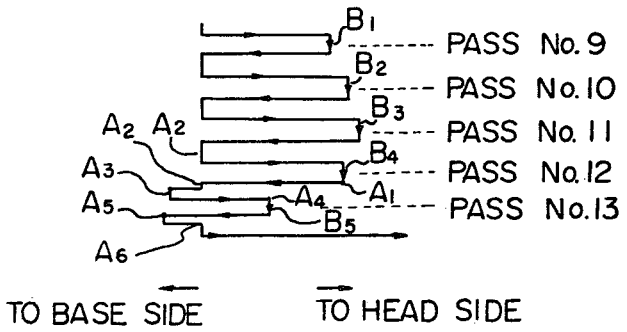
Figure 12:
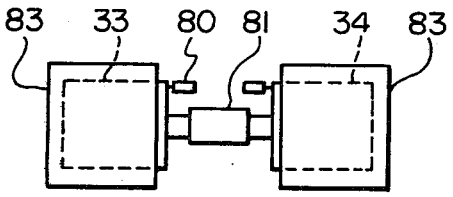

FIGS. 9*a* and 9*b* are roll force VS. thickness diagrams for the head and base vertical rolls, respectively for explaining how the roll gaps are determined;

FIG. 10 is a block diagram of a control system for positioning the vertical rolls;

FIG. 11 is a schematic view showing the movement of a horizontal roll during actual universal rolling; and FIG. 12 is a view showing a hydraulic jack and dial gages adapted to measure the mill spring in FIG. 8.

Figure 1A:
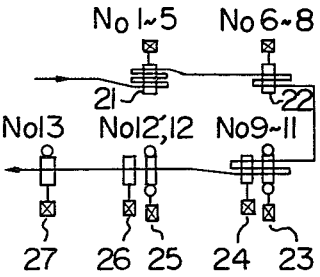
Fig. 1 a PRIOR ART
Figure 3A:
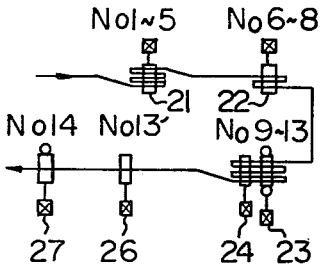
Figure 3B:
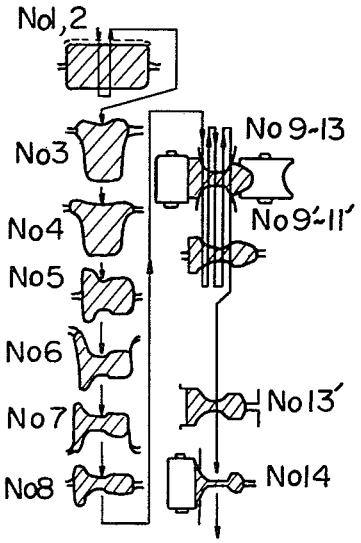

FIG. 3*a* illustrates one example of the rolling installation for carrying out the rolling method according to the present invention. The installation illustrated in FIG. 3*a* is essentially the same as that in FIG. 1*a*, which is a conventional installation, with exception of the absence of the second universal rolling mill 25 (FIG. 1*a*). In FIG. 3*a* similar parts to those in FIG. 1*a* are designated by the same reference numerals as used in FIG. 1*a*. FIG. 3*b* illustrates the pass schedule with numbers corresponding to the pass numbers in FIG. 3*a*. Square blooms are broken down through pass Nos. 1–5 in a break-down mill 21 and, then, roughly rolled through pass Nos. 6–8 in a roughing mill 22 having upper and lower horizontal rolls. The rolled blank is further rolled through pass Nos. 9–13 in a universal rolling mill 23 and an edger mill 24, and thereafter, through a pass No. 13' in an edger mill 26. The thus rolled blank is then finish rolled through a pass No. 14 in a finishing mill 27.

According to the present invention, roll gaps at respective passes are preset, taking into consideration the relation of the rolling force of the vertical rolls VS. the displacements of the vertical and horizontal rolls, due to differences in the rolling force. The circumferential surface of the head vertical roll is in contact with the side surfaces of the horizontal rolls (the afore-mentioned metal touch rolling) in the final pass in the multiple pass universal rolling, so as to shift the head vertical roll and the horizontal rolls toward the base vertical roll.

First, the effects of the displacements of horizontal and vertical rolls, due to elastic deformations of rolling mills during rolling, on the shapes of calibers or on the cross-sectional configuration of the rolled blank will be explained below. The displacements of the rolls affecting the shapes of calibers include: (1) axial displacements of the horizontal rolls due to the difference of the asymmetric rolling force acting on each of the vertical rolls; (2) radial displacements of the vertical rolls (roll separations) themselves in the axial directions of the horizontal rolls due to the rolling force acting upon the vertical rolls, and; (3) the free displacements of the vertical rolls in the axial directions of the horizontal rolls, due to the looseness in the vertical roll screw down mechanisms.

With the axial displacements of the horizontal rolls due to the difference in the asymmetrical rolling force on each of the vertical rolls, a force P required to roll the head or the base of a rail into predetermined dimensions by means of the vertical rolls can be obtained from the following equation, as is well known.

$$P = K_{fm}(T, \ln h_1/h_2) \cdot W \cdot \sqrt{R(h_1 - h_2)} \cdot Q_p(h_1, h_2, R) \quad (2)$$

where $K_{fm}$ is a mean deformation resistance, and a function of the rolling temperature T and ingoing and outgoing thicknesses $h_1$ and $h_2$ of the head or base of the rail and $\ln h_1/h_2$ is a natural logarithmic strain, W is a width of the head or base of the rail R is a radius of the vertical rolls, and $Q_p$ is a profile coefficient of which factor are $h_1$, $h_2$ and R.

Figure 4:
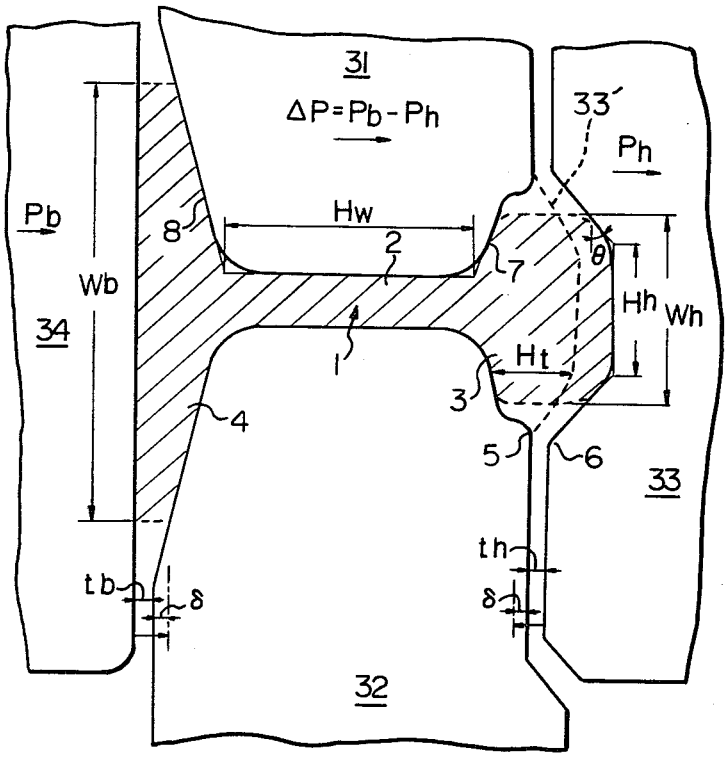
FIG. 4 is a detailed view of calibers to be used in the rolling method according to the invention.

The thermal rundown in the head portion 3 of a blank 1 is less than that in a base 4, because the head portion has larger cross-sectional area and smaller surface area and the base portion vice versa, as illustrated in FIG. 4. Therefore, $T_h > T_b$ is apparent. (Suffixes "h" and "b" designate the head and base, respectively, here and hereinafter.) Accordingly, with regard to mean deformation resistances $k_{fm}(\text{head}) < k_{fm}(\text{base})$. Moreover, with regard to reduction in thickness h, generally $\Delta h_h >> \Delta h_b$. However, with regard to a reduction ratio ($\Delta h/h$), the following equation can be obtained, taking the bend of the blank due to an unbalance of the elongation during rolling into consideration; $(\Delta h/h)_h \approx (\Delta h/h)_b + 2 \sim 3\%$. Furthermore, with regard to the widths W of the blank at the head and base, $2W_h < W_b$. Owing to these relations, $P_h < P_b$ is obtained from the equation (1). Namely, horizontal rolls 31 and 32 are subjected to a force $\Delta P = P_b - P_h$ in the axial directions of these rolls toward a head vertical roll 33.

Figure 5:
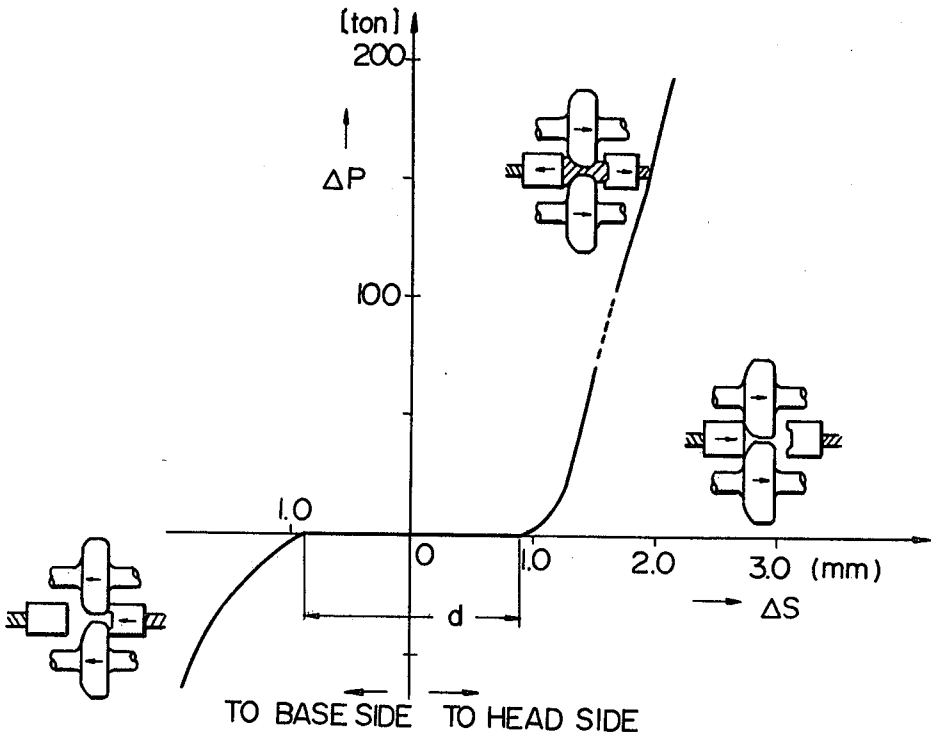
FIG. 5 is an axial displacement—vertical roll force difference diagram showing one example of the relationship between axial displacement of the horizontal rolls and the roll force difference acting upon the vertical rolls.

The horizontal rolls 31, 32 are displaced toward the head vertical roll 33 by the elastic deformation of a mill housing 42, roll chocks 44 (FIG. 6) and the general mechanical looseness of the mill, caused by the force difference ΔP. FIG. 5 is a graph illustrating one example of the relation between the axial displacement ΔS of the horizontal roll and force difference ΔP of the vertical rolls. According to the graph, when the force difference is around 70 [t] in an actual rolling of rails, the horizontal rolls are displaced approximately 1.5 [mm]. The dead band d with respect to the horizontal roll axial rigidity is about 2 [mm]. The graph in FIG. 5 was determined by the force measured by a rolling force sensor such as a load cell 40 (FIG. 6) and displacements measured by an axial displacement sensor 38 (FIG. 6) of a differential transformer system when horizontal rolls were urged through vertical rolls by roll screws 41 (FIG. 6) in an actual rolling mill.

It can be easily understood that if calibers are set as they are drawn in design drawings without considering the displacements of the horizontal rolls, the blank will be rolled into rails having thinner heads and thicker bases than required.

Figure 6:
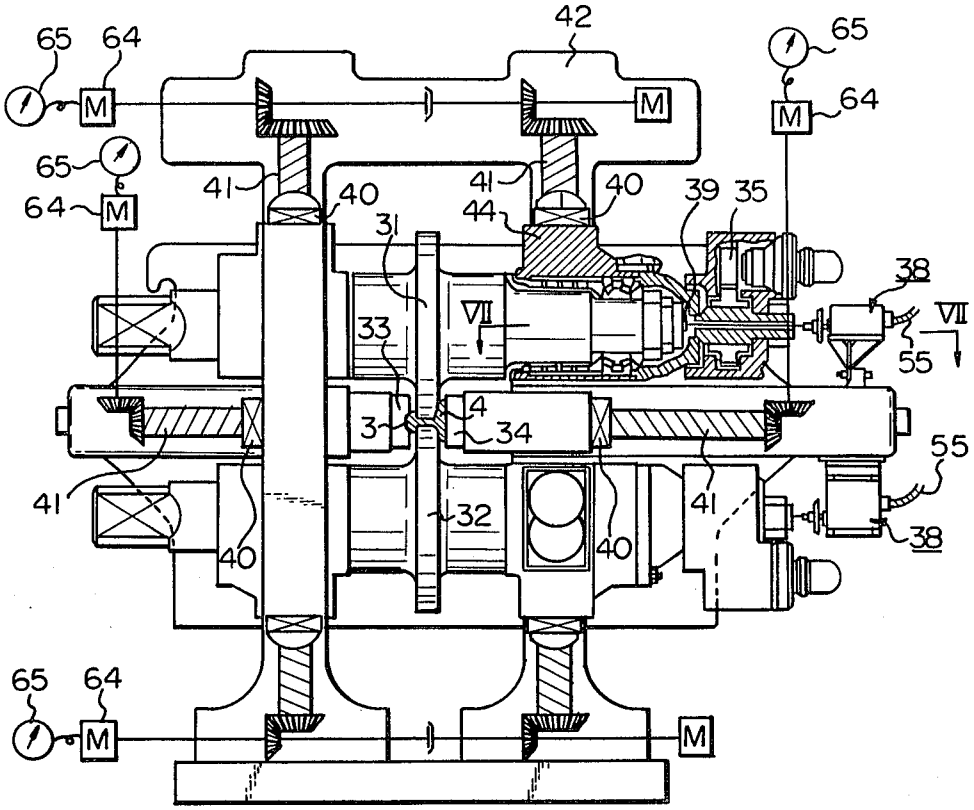
FIG. 6 is a partially sectional front elevational view illustrating rolling mills equipped with axial displacement sensors.
Figure 7:
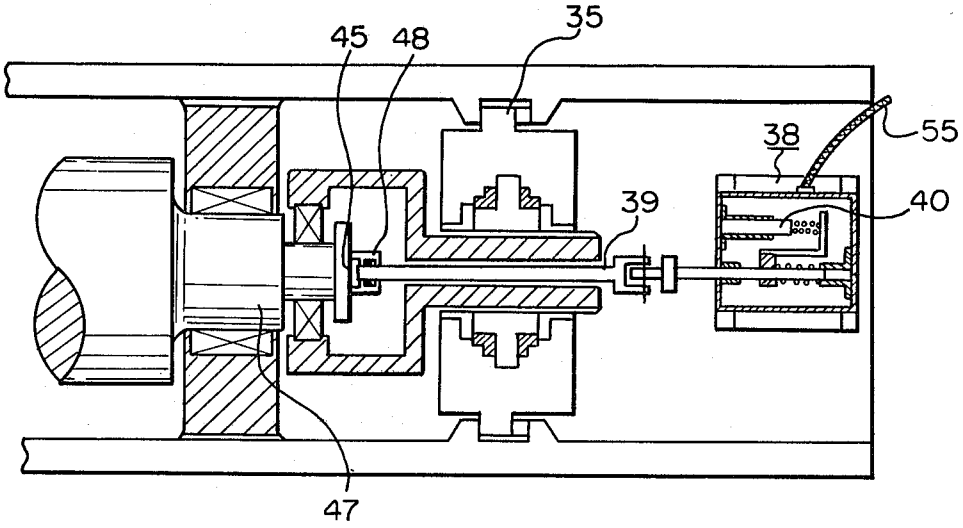
FIG. 7 is a sectional view taken along the line VII—VII in FIG. 6.

An example of the axial displacement sensor is illustrated in FIG. 6, which is a partially sectional front elevational view illustrating an example of a rolling mill equipped with roll axial displacement sensors 38. FIG. 7 is a sectional view, taken along the line VII—VII in FIG. 6. The sensor 38 is a positional transducer, known per se, for transforming the mechanical displacement of a roll to an electrical value with the aid of a detector rod 39 which has a detector head 48 adapted to be in contact with one end 45 of the roll neck 47 of the roll with the help of a spring (not shown) and which is connected to an encoder element. For this purpose, a differential transformer 40 known per se or a magnetic scale (not shown) is used as the encoder element. The sensors 38 are electrically connected to indicators (not shown) by means of cables 55 (FIG. 6).

The discussion will now be directed to how the aforementioned second displacement, i.e. the radial displacement of the vertical rolls themselves, effects the sectional configuration of the rail.

The vertical rolls on both sides are subjected to rolling forces from the blank being rolled, so that the rolls tend to move away from each other. These rolling forces cause elastic deformations of the housing 42, screw down mechanisms comprising the roll screws 41, the roll chocks 44 and the like (FIG. 6), so that the vertical rolls 33 and 34 move away from each other in the axial directions of the horizontal rolls 31 and 32.

FIG. 8 is a graph illustrating a relationship between mill spring (aforementioned radial displacements of vertical rolls) $\Delta S_v$ and vertical roll rolling forces P, where $P_h(\Delta S_v)$ and $P_b(\Delta S_v)$ indicate these amounts on the head side and base side, respectively. In FIG. 8, for example, when a rolling force is 100 [t], the vertical rolls are displaced about 0.8 [mm] on one side. The data in FIG. 8 were obtained by measuring the displacements of the vertical rolls by means of dial gages 80 (FIG. 12) or the like, and measuring the forces by means of rolling pressure gages (load cells) when the head and base vertical rolls 33, 34 supported in vertical roll cases 83 in an actual rolling mill were forced away from each other by means of a hydraulic jack 81 (FIG. 12).

Owing to the displacements of the vertical rolls described above, the heads and bases of the rolled blank are thicker than the size of the calibers which are set in accordance with the design drawings.

Finally, how the aforementioned third displacements, i.e., the radial displacements of the vertical rolls caused due to the looseness in the vertical roll screw down mechanisms, effect the sectional configurations of rolled blank will be explained. When a rolling force is applied to the vertical rolls, they are displaced away from each other owing to the elasticities and play in and between worms, worm wheels, thread screws and the like of the mill. Therefore, similarly to the case of the above mentioned second displacement, the heads and bases of the rolled product are thicker than those of the calibers which are set in accordance with the design drawings.

According to the present invention, the calibers for respective passes are set in consideration of the above mentioned displacements of rolls, so as to roll the blank at predetermined dimensions. In actually setting the calibers for the purpose of eliminating the looseness in vertical roll screw down mechanisms, the side surfaces of the horizontal rolls and the circumferential surfaces of the vertical rolls are brought into contact with each other, and under this condition the vertical rolls are further passed against the horizontal rolls by the force $P_o$ applied at low speeds to obtain a preset value of $\delta$ (FIG. 4). Since the object of the value $\delta$ is to delete the effect of the looseness in the vertical roll screw down mechanism, it must be carefully determined taking into consideration the limit value of electric circuit of the screw down mechanism. Referring to FIG. 8, the value $\delta$ in the rolling mill used in the present invention is preferably less than 1 [mm] ($\delta<1$ [mm]).

The positions of the vertical rolls in the screw down direction are detected by means of selsyn motors 64 (FIG. 6) connected to the screws 41 of the screw down mechanisms and roll gap indicators 65 based on the position of the screws 41. The circumferential surface of the head vertical roll, (rail head side) as designated by 33' (FIG. 4), is positioned so that it touches the horizontal rolls: and in this position the reading of the indicator 65 is set at "0." After that the vertical rolls are pressed against the horizontal rolls to an extent such that the indicator shows the predetermined value $\delta$ and the reading of the indicator is again set at "0."

The roll gaps between the vertical rolls and the horizontal rolls are determined with the qualification that the vertical rolls must be positioned with the preset value $\delta$ as above described.

With respect to the pass schedule as a whole, however, the reduction ratios ($\Delta h/h$) of the vertical rolls are selected in such a way that the ratios in the earlier passes of the multiple pass schedule are larger than those in the latter passes and that the ratios always satisfy the relation, $(\Delta h/h)_{i+1}<(\Delta h/h)_i$, where i is the pass number. In this case, the reduction ratios at the head and base are made substantially the same as described above.

FIGS. 9*a* and 9*b* are diagrams for determining the roll gaps of the vertical rolls at the heads and bases, respectively, whose abscissas indicate the gap S of the rolls and ordinates indicate the vertical roll rolling forces P. The suffixes "h" and "b" indicate the head and base sides, respectively. In these diagrams, the curves $f(h_1,h_2)$ are rolling force curves based on the reference thickness $h_1$ of the blank to be rolled at the entrance. The rolling forces $P_h$ or $P_b$ can be obtained from the outgoing thickness $h_2$ of the blank. The roll gaps between the vertical and horizontal rolls at the head and base are indicated by th and tb, which are obtained by the design calculation, respectively (FIG. 4).

The force difference $\Delta P=P_b-P_h$ is obtained from the rolling forces $P_h$ and $P_b$ thus obtained and, accordingly, the axial displacements $\Delta S$ of the horizontal rolls are obtained by referring to FIG. 5. Since the horizontal rolls are displaced toward the head sides as described above, the roll gaps must be determined so as to be larger by $\Delta S$ at the head side and smaller by $\Delta S$ at the base side than the value $h_2$ obtained by the design. Moreover, since the vertical rolls are separated away from each other by the rolling forces in the axial directions of the horizontal rolls, the roll gaps of the vertical rolls must be determined in consideration of the values of these roll separations.

Furthermore, since the reading of the roll gap indicators 65 is set at "0" under the metal touch conditions with preset value of $\delta$, as a matter of fact, the roll settings $S_h$ and $S_b$ are larger by the values $\delta$ than the read out, when the vertical rolls and the horizontal rolls come into contact under no load condition, as can be seen from FIGS. 9*a* and 9*b*.

FIGS. 9*a* and 9*b* include the mill rigidity curves $P_h(\Delta S_v)$ and $P_b(\Delta S_v)$, from which required roll gaps of the vertical rolls are directly obtained along the arrows. The $M_h$ and $M_b$ in FIGS. 9*a* and 9*b* are equivalent to spring modulous of the mill.

From the above facts, the gap $h_2$ of the vertical rolls determined by the design are adjusted by the following equations in view of the elastic deformation of the rolling mill.

$$\left.\begin{aligned}\Delta S'_h \text{ (on head side)} &= \Delta S - P_h/M_h + \delta \\ \Delta S'_b \text{ (on base side)} &= \Delta S + P_h/M_b - \delta\end{aligned}\right\} \quad (3)$$

While the rolling by the universal rolling mills is effected according to the pass schedules in the above mentioned manner, the final pass or the equivalent in the universal rolling mill is carried out in the following manner. In the passes other than the final pass, the horizontal and vertical rolls are indirectly in contact with each other through the materials to be rolled. In the final pass, the circumferential surface of the head vertical roll is brought into direct contact with the side surfaces of the horizontal rolls in the same manner as the "metal touch" mentioned above. Namely, the gap $S_h$ of the head vertical roll in the final pass are preferably set in the relations $S_h \leqq \delta$ and $\delta - S_h < P_h/M_h$ (where $P_h$ is the rolling force on the head vertical roll in the final pass), thereby ensuring the "metal touch" rolling. In this case, since $\Delta S=P_h/M_h$ is retained, the gap $S_b$ of the base vertical roll is also determined.

In the final pass (or the equivalent), the head vertical roll is pressed against the horizontal rolls so that the head vertical roll and the horizontal rolls are shifted by the value $\delta$. As a result, the displacements of the head vertical roll and the horizontal rolls can be compensated by the shift thereof.

The method of positioning the vertical rolls having a desired gap will now be explained referring to FIG. 10, illustrating a block diagram of the roll position control system. The position control of the roll is carried out by a direct digital control by means of a digital computer 61 (e.g. see FIG. 8 on page 8, of UDC 621, 771, 262 "NIPPON STEEL TECHNICAL REPORT OVERSEAS" No. 3 June, 1973). The desired gap of the vertical rolls, i.e., the set value a obtained in the above mentioned manner, the actual gap b of the vertical rolls and an admissible signal c from a speed control system 63 (e.g. see page 296 of "Control System for Electric Motors," by Denki Shoin, Nov. 30, 1973, in Japan) are input into the digital computer 61. The current gap b is detected by a transmit selsyn 65 connected to a screw down selsyn motor 64 and is input through a receive selsyn 66 and an encoder 67 into the digital computer 61.

The roll gap of the vertical rolls is set at "0," which is stored as a reference in the digital computer 61. Subsequently, upon receipt of an admissible signal c, indicating permission to drive the mechanical system from the speed control system 63, the digital computer 61 generates a signal for starting a roll position adjustment, which is input into the speed control system 63, which feeds a brake releasing signal d to a brake 68 of the motor 64. Moreover, the digital computer 61 computes a speed pattern e from a deviation, i.e., difference E between the set value a and a current value b, and the speed pattern e is input through a digital-analog converter 62 into the speed control system 63. The motor 64 is operated according to a manipulated variable f from the speed control system 63 to set the vertical rolls in position. When the deviation E becomes less than a deviation allowable value $\epsilon$ (allowable deviation) a close signal g is supplied from the digital computer 61 into the speed control system 63, from which a brake applying signal d is then fed into the brake 68.

In order to roll the rail through multiple passes by means of a single universal rolling mill according to the pass schedule, it is desirable to use calibers of the following contours.

First, a hot finished contour of a product is determined in the same manner as in usual caliber designs, based upon which dimensions of respective parts of the calibers are then determined. As shown in FIG. 4, the thickness (Ht) of the head is substantially the same as the hot finished dimension, the width (Hh) of the head is the hot finished dimension +4 through 7 [mm], and the oblique angle $\theta$ of the inclined surface of the head is approximately 45°. In order to reduce the surface pressure when the head vertical roll 33 is in contact with the horizontal rolls 31 and 32, the contact surfaces therebetween are made as wide as possible. The inclinations of oblique surfaces 7 and 8 of a web 2 on the head and base sides are substantially the same as those of the finished rail, and the width (Hw) of the web is less than the hot finished dimension +1 [mm] in order to obtain inner width expansions in the following passes and ensure the stability of the rolled material. The roll gap (tb) between the head vertical roll and the horizontal rolls is sufficient to accommodate the extensions of the base without interferring with the free rolling of the vertical rolls at the horizontal roll dead band when the head vertical rolls 33 are urged in the final pass.

It will be understood that the extreme end of the head 3 of the rolled blank must be of a contour sufficient to be accommodated in a caliber of the head vertical roll 33.

As explained above in detail, the present invention utilizes the mill rigidity curve of vertical rolls in conjunction with the principal of the gage-meter system (BISRA method), while maintaining the horizontal roll axial displacement checking mechanism of the conventional shaped steel mills and the dead band of the mill rigidity curve in the axial direction as they are. This enables a single universal mill to roll materials in multiple pass rolling into asymmetrical shaped steels, such as rails, with high accuracy in desired contours. Such steels have previously been impossible to roll with the required accuracy by means of one set of conventional mills.

FIG. 11 shows experimental results of the movement of the horizontal roll 31 during actual rolling according to the present invention. The movement was measured by the roll displacement sensor. Corresponding to FIG. 11, the blank was rolled by the universal rolling mill 23 illustrated in FIG. 3*a*. The horizontal roll 31 occupied different positions in the course of rolling designated by the pass Nos. 9–13. The line extending along the arrows denoted the movement of the end 45 (FIG. 7) of the upper horizontal roll 31 during the pass Nos. 9–13.

As mentioned above, and as can be seen from FIG. 11, the upper horizontal roll does not stay at its pre-rolling position but is displaced toward the head vertical roll at every pass. The chart simulates how the rolling is effected, therefore only at the vertical portions of the diagram line, say; $B_1$, $B_2$, $B_3$, $B_4$, $B_5$ in FIG. 11, actual rolling is being executed for every pass number.

After returning to the initial positions of the horizontal roll in the pass No. 13, the pre-rolling position of the roll is moved again toward the base side in comparison with those in other pass Nos. This shows, during presetting the head vertical roll, the horizontal rolls are pressed by the head vertical roll toward the base side so that the metal touch is established between the head vertical roll and the horizontal rolls. Furthermore, the reason the displacement of the roll during rolling in the pass No. 13 is less than half those of the roll in the four other passes Nos. 9–12 is because the displacements of the horizontal rolls are restrained by the head vertical roll. This means that the metal touch rolling can be achieved while maintaining the close contact between the head vertical roll and the side surfaces of the horizontal rolls.

The end 45 of the roll 31 in the passes Nos. 9–12 is returned to the initial position $A_2$, when the blank is not rolled, and is displaced to position $A_1$, during rolling at pass No. 12. On the other hand, the roll in the pass No. 13 is located at position $A_3$ when the blank is not rolled. That is, when the roll gaps of the pass No. 13 are set, the positions of the rolls 31 and 32, which are racing, are moved from the position $A_2$ to $A_3$. This is because the horizontal rolls 31 and 32 are pushed by the head vertical roll.

After the blank comes into the caliber, the horizontal rolls are displaced toward the head vertical roll since the rolling force $P_b$ on the base is larger than the rolling force $P_h$ on the head side ($P_b > P_h$), as mentioned before. During the displacement of the horizontal rolls, the head vertical roll is in close contact with the side faces of the horizontal rolls while satisfying the inequality; $\delta - S_h < P_h < M_h$, the horizontal rolls are moved only up to the position $A_4$. If the reduction amount of the head of the blank is relatively large, the above mentioned inequality is not established, so that the head vertical roll is separated from the horizontal rolls, resulting in no establishment of the metal touch.

After the blank comes out of the caliber, the horizontal rolls are moved to the position $A_5$, which is approximately the same as the position $A_3$, while being pressed against the head vertical roll. The horizontal rolls are not separated from the head vertical roll until the roll gaps at the pass No. 9 are again set. After the roll gaps at the pass No. 9 are set, the horizontal rolls are displaced from the position $A_5$ to the position $A_6$, i.e. the initial position.

The present invention has the following advantages.

Figure 1B:
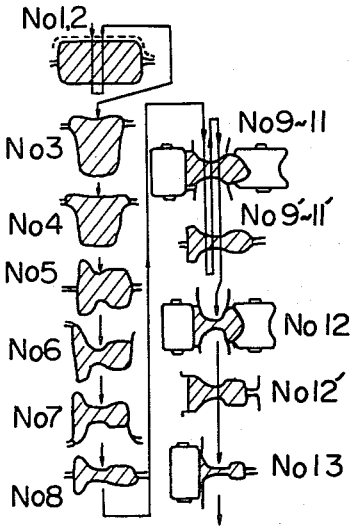
Fig. 1 b PRIOR ART
Figure 2:
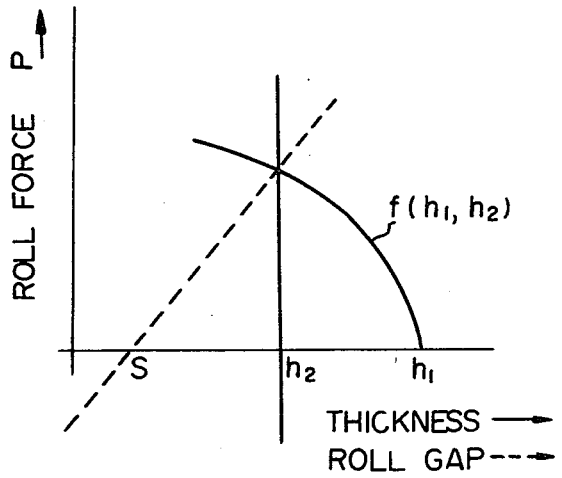
Figure 3C:
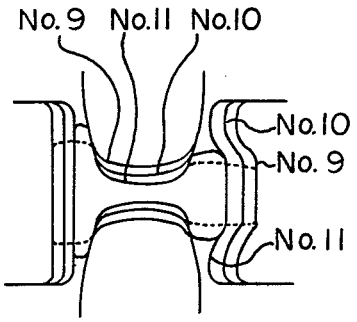
Fig. 3c PRIOR ART
Figure 3C:
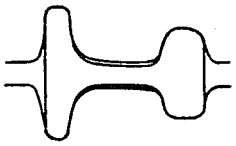
Fig. 3c PRIOR ART
Figure 3C:
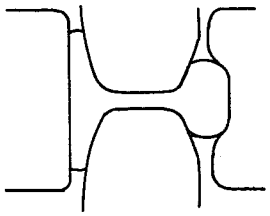
Fig. 3c PRIOR ART
Figure 3D:
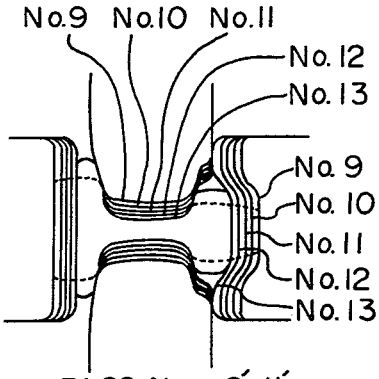
Figure 3D:
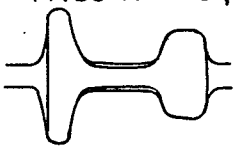

(1) As described above, the number of mills can be decreased even in the case of existing rolling installations. When the conventional rail rolling installation illustrated in FIG. 1*a* and the pass schedule thereof in FIGS. 1*b* and 3*c* are compared to the rolling installation illustrated in FIG. 3*a* and the pass schedule in the rolling method applied with the present invention in FIGS. 3*b* and 3*d*, although the schedule according to the present invention includes no second universal rolling mill 25 (FIG. 1*a*), the rails produced by the present invention are not inferior in dimensional accuracy to those manufactured by the prior art method.

(2) Since the universal rolling is superior in shaping performance to other rolling, the reduction of area per one pass can be increased if the strength and horsepower of the driving system of a mill can be increased, thereby increasing the rolling efficiency. Furthermore, if the caliber system or roughing mills is modified, three rolling mills are capable of rolling square blooms into asymmetrical shaped steels, such as rails.

(3) As the universal calibers of the intermediate rolling processes perform a large part of the plastic working, the calibers of the roughing mills, whose rolls have been thus reduced, are able to perform a reasonable part of the bloom sizing operation, thereby enabling the sizes of blooms to be concentrated within a narrower range, whereby the utilization of blooms made by the continuous casting can be increased.

(4) The present invention can greatly reduce not only the initial investment cost of a rail rolling factory, but also, the running costs of the mill.

We claim:

1. A method for multiple pass rolling of blanks into shapes having unequally thick flanges, one of said flanges being a base flange and another of said flanges being a head flange, said head flange being thicker than said base flange, in a universal rolling mill comprising a pair of horizontal rolls and a pair of vertical rolls, said universal rolling mill performing precise repetitive rolling in the same rolling stand, making said universal rolling possible with less number of stands having a conventional screw down mechanism, compensating vertical roll-set-up inaccuracy because of the horizontal roll axial displacement during rolling due to the imbalance of vertical-roll forces, even under the rolling condition of uniform longitudinal elongation generally meant for minimizing bending of a blank, said imbalance of vertical roll forces caused by the unequal contact area of the flange width and unequal deformation resistance resulting from the non-uniform temperature of the unequal flange thickness; said method comprising the steps of:

determining axial displacement of said horizontal rolls and radial displacement of vertical rolls based upon a reduction schedule when said blank passes through a specific roll pass surrounded by said horizontal and vertical rolls;

analyzing the displacements in terms of roll force so as to determine the non-linear relationship between the axial displacement of horizontal rolls and the roll-force difference acting on each of the two vertical rolls;

setting the base flange roll gap for each pass to correspond to the base flange outgoing thickness minus the base flange vertical roll mill spring minus the corresponding axial displacement of the horizontal rolls; and setting the head flange roll gap for each pass to correspond to the head flange outgoing thickness minus the head flange vertical roll mill spring plus the corresponding axial displacement of the horizontal rolls, said base and head flange vertical roll mill springs being determined in accordance with the base and head vertical roll force, respectively, divided by the base and head vertical roll mill modulus, respectively, and said corresponding axial displacement being determined by said non-linear relationship using a predicted difference of said two vertical roll forces; and repeatedly passing said blank through said universal rolling mill with the successive roll gaps set for each pass of the multiple-pass roll schedule in accordance with said setting steps, thereby allowing actual multiple precise rolling of the universal rolling mill without any augmenting roll stand.

2. A method according to claim 1, wherein one of said vertical rolls and said horizontal rolls are shifted toward the other of said vertical rolls and pass schedules are selected from the relationship between the blank thickness and the rolling forces of the vertical rolls, so that the roll gap between the horizontal rolls and said other vertical roll is zero at the final pass, and the rolling can be effected while balancing the rolling forces acting on the vertical rolls, without use of a subsequent universal roll stand.

* * * * *